US009097253B2

(12) United States Patent
Ginies et al.

(10) Patent No.: US 9,097,253 B2
(45) **Date of Patent: *Aug. 4, 2015**

(54) SCROLL REFRIGERATION COMPRESSOR WITH CONFLUENT BYPASS PASSAGE AND FLOW PASSAGE

(75) Inventors: Pierre Ginies, Sathonay Village (FR); Jean-Francois Le Coat, Villefranche sur Saone (FR); Dominique Gross, Jassans Riottier (FR); Patrick Jallat, Jassans Riottier (FR); Stephane Watts, Lyons (FR)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 60 days.

This patent is subject to a terminal disclaimer.

(21) Appl. No.: 13/994,875

(22) PCT Filed: Nov. 28, 2011

(86) PCT No.: PCT/FR2011/052777

§ 371 (c)(1),
(2), (4) Date: Aug. 2, 2013

(87) PCT Pub. No.: WO2012/080609

PCT Pub. Date: Jun. 21, 2012

(65) Prior Publication Data

US 2013/0309118 A1 Nov. 21, 2013

(30) Foreign Application Priority Data

Dec. 16, 2010 (FR) ..... 10 60591

(51) Int. Cl.
*F03C 2/00* (2006.01)
*F03C 4/00* (2006.01)

(Continued)

(52) U.S. Cl.
CPC ..... *F04C 18/0215* (2013.01); *F04C 18/0253* (2013.01); *F04C 18/0261* (2013.01); *F04C 28/26* (2013.01); *F04C 29/04* (2013.01); *F04C 29/128* (2013.01); *F04C 23/008* (2013.01)

(58) Field of Classification Search
USPC ..... 418/15, 55.1–55.6, 57, 180, 270, 418/DIG. 1; 417/307, 308, 310, 410.5, 440
See application file for complete search history.

(56) References Cited

U.S. PATENT DOCUMENTS 4,696,630 A * 9/1987 Sakata et al. ..... 418/55.5
5,090,880 A 2/1992 Mashimo (Continued)

FOREIGN PATENT DOCUMENTS

CA 2544112 A1 11/2006
CN 1158944 A 9/1997

(Continued)

OTHER PUBLICATIONS

International Search Report issued in International Patent Application No. PCT/FR2011/052777 dated Mar. 5, 2013 (w/ translation).

(Continued)

*Primary Examiner* — Theresa Trieu
(74) *Attorney, Agent, or Firm* — Oliff PLC

(57) ABSTRACT

The scroll compressor includes stationary and moving scrolls each including a scroll plate provided with a spiral wrap, the spiral wraps defining the variable-volume compression chambers, a separating plate mounted on the scroll plate of the stationary scroll and defining with the latter a first intermediate volume, and a delivery chamber defined by the separating plate and the sealed casing. The compressor includes a bypass passage arranged to communicate the first intermediate volume with an intermediate compression chamber, a flow passage arranged to communicate the first intermediate volume with the delivery chamber, and a bypass valve associated with the flow passage, each bypass valve associated with a flow passage mounted on the surface of the separating plate turned toward the delivery chamber and movable between closing and opening positions for closing and opening the flow passage.

11 Claims, 3 Drawing Sheets

(51) Int. Cl.

| | |
|---|---|
| ***F04C 2/00*** | (2006.01) |
| ***F04C 18/02*** | (2006.01) |
| ***F04C 29/04*** | (2006.01) |
| ***F04C 28/26*** | (2006.01) |
| ***F04C 29/12*** | (2006.01) |
| *F04C 23/00* | (2006.01) |

(56) References Cited

U.S. PATENT DOCUMENTS

| | | | | | |
|---|---|---|---|---|---|
| 5,169,294 | A | * | 12/1992 | Barito | 417/310 |
| 5,567,137 | A | * | 10/1996 | Nakashima et al. | 418/55.5 |
| 5,674,058 | A | | 10/1997 | Matsuda et al. | |
| 5,855,475 | A | | 1/1999 | Fujio et al. | |
| 6,227,830 | B1 | * | 5/2001 | Fields et al. | 418/55.1 |
| 6,494,688 | B1 | | 12/2002 | Barito et al. | |
| 2004/0057848 | A1 | | 3/2004 | Haller et al. | |
| 2007/0217938 | A1 | | 9/2007 | Cho | |
| 2009/0041603 | A1 | * | 2/2009 | Ginies et al. | 418/55.6 |
| 2009/0185926 | A1 | | 7/2009 | Bush | |

FOREIGN PATENT DOCUMENTS

| | | | | | |
|---|---|---|---|---|---|
| CN | 1854525 | A | | 11/2006 | |
| JP | S63-117187 | A | | 5/1988 | |
| JP | H08-47053 | A | | 2/1996 | |
| JP | H08-247053 | A | | 9/1996 | |
| JP | 10077977 | A | * | 3/1998 | F04C 18/02 |
| JP | H11-324950 | A | | 11/1999 | |
| JP | 2002364565 | A | * | 12/2002 | F04C 18/02 |
| JP | 2003254267 | A | * | 9/2003 | F04C 18/02 |

OTHER PUBLICATIONS

Jul. 20, 2011 Preliminary Search Report issued in French Patent Application No. 1060594.

Nov. 7, 2014 Office Action issued in U.S. Appl. No. 13/994,952.

Mar. 5, 2013 International Search Report issued in International Patent Application PCT/FR2011/052777.

Jul. 8, 2011 French Preliminary Search Report issued in Application No. 1060590.

* cited by examiner

SCROLL REFRIGERATION COMPRESSOR WITH CONFLUENT BYPASS PASSAGE AND FLOW PASSAGE

The present invention relates to a scroll refrigeration compressor.

BACKGROUND OF THE INVENTION

In a known manner, a scroll refrigeration compressor comprises a sealed casing containing a stationary scroll and moving scroll following an orbital movement, each scroll including a scroll plate from which a spiral wrap extends, the spiral wraps of the stationary and moving scrolls being engaged in one another and defining variable-volume compression chambers, the compression chambers having a volume that decreases gradually from the outside, where the refrigerant gas is admitted, toward the inside.

Thus, during the relative orbital movement of the first and second scrolls, the refrigerant gas is compressed due to the decrease in the volume of the compression chambers and conveyed to the center of the first and second scrolls. The compressed refrigerant gas leaves from the central part toward a delivery chamber through a delivery conduit formed in the central part of the stationary scroll.

In order to improve the performance of such a compressor depending on the season, and more particularly depending on the demand for cold, this compressor may have a variable capacity and/or a variable compression rate.

Document U.S. Pat. No. 5,855,475 describes a scroll refrigeration compressor with a variable compression rate on the one hand comprising refrigerant fluid passage orifices formed in the scroll plate of the stationary scroll and each respectively emerging in one of the compression chambers and in the delivery chamber, and on the other hand bypass valves disposed on the surface of the scroll plate of the stationary scroll turned toward the side opposite the spiral wraps and each movable between an open position, allowing refrigerant fluid to be delivered from the corresponding compression chamber to the delivery chamber, and a closed position, preventing refrigerant fluid from being delivered from the corresponding compression chamber to the delivery chamber.

When one of the bypass valves is subjected, on the face thereof turned toward the scroll plate of the stationary scroll, to a pressure lower than the pressure in the delivery chamber, said valve is kept in its closed position and isolates the corresponding compression chamber from the delivery chamber. As a result, the compression rate of the compressor is kept at its maximum value.

When one of the bypass valves is subjected, on the face thereof turned toward the scroll plate of the stationary scroll, to a pressure higher than the pressure in the delivery chamber, said valve deforms elastically toward the open position thereof and communicates the corresponding compression chamber with the delivery chamber. This therefore results in a delivery to the delivery chamber of part of the refrigerant fluid compressed in the compression chambers in which the passage orifices emerge before that part of the refrigerant fluid reaches the center of the spiral wraps.

The presence of such passage orifices and such bypass valves makes it possible to decrease the compression rate of each compression chamber as a function of the operating conditions, and to thereby avoid over-compressing the refrigerant fluid. These arrangements must make it possible to improve the energy output of the compressor.

In order to decrease the mechanical forces exerted on the stationary scroll, and therefore on the moving scroll and the drive shaft of the moving scroll, and to decrease the heat transfer from the delivery chamber to the compression chambers through the stationary scroll, it is known to mount a separating plate on the face of the scroll plate of the stationary scroll turned toward the delivery chamber such that said delivery chamber is at least partially defined by the sealed casing of the compressor and the separating plate. The presence of such a separating plate thereby makes it possible to increase the reliability of the compressor.

Furthermore, in order to still further improve the reliability of the compressor, it is known to mount the separating plate movably with respect to the stationary scroll in a direction substantially parallel to the longitudinal axis of the compressor.

Installing bypass valves, as described in document U.S. Pat. No. 5,855,475, on the upper surface of a stationary scroll of the compressor equipped with a separating plate is difficult, or even impossible, due to the fact that access to the upper surface of the stationary scroll is hindered by the presence of the separating plate.

SUMMARY OF THE INVENTION

The present invention aims to resolve these drawbacks.

The technical problem at the base of the invention therefore consists of providing a scroll refrigeration compressor that has a simple and cost-effective structure, and that makes it possible to improve the performance of the compressor, while allowing a simple and easy assembly of at least one bypass valve.

To that end, the present invention relates to a scroll refrigeration compressor comprising:

- a sealed casing containing a stationary scroll and a moving scroll following an orbital movement, each scroll including a scroll plate from which a spiral wrap extends, the spiral wraps of the stationary and moving scrolls being engaged in one another and defining variable-volume compression chambers,
- a separating plate sealably mounted on the scroll plate of the stationary scroll, the separating plate and the scroll plate of the stationary scroll defining at least one first intermediate volume,
- a delivery chamber at least partially defined by the separating plate and the sealed casing, wherein the compressor further comprises:

- at least one bypass passage arranged to communicate the first intermediate volume with an intermediate compression chamber,
- at least one flow passage arranged to communicate the first intermediate volume with the delivery chamber,
- at least one bypass valve associated with the flow passage, each bypass valve associated with a flow passage being mounted on the surface of the separating plate turned toward the delivery chamber and movable between closing and opening positions for closing and opening the corresponding flow passage, and being designed to be moved into the opening position thereof when the pressure in the corresponding flow passage exceeds the pressure in the delivery chamber by a predetermined value.

The fact that at least one bypass passage and at least one flow passage emerge in the same intermediate volume delimited by the separating plate and the scroll plate of the stationary scroll allows an alignment defect between the ends of the bypass and flow passages during the assembly of the separating plate on the scroll plate of the stationary scroll, while ensuring a fluid connection between said bypass and flow passages. This results in an easy and quick assembly of the separating plate on the scroll plate of the stationary scroll, since it is not necessary to take significant precautions during positioning thereof to ensure the fluid connection between the corresponding bypass and flow passages.

Furthermore, these arrangements make it possible to produce flow and bypass passages in the separating plate and the scroll plate of the stationary scroll in positions that are radially and angularly offset with respect to the longitudinal axis of the compressor, while ensuring an easy and quick fluid connection between said passages during assembly of the separating plate on the scroll plate of the stationary scroll.

As a result, the positioning of the various bypass valves may be done by assembling each bypass valve on the separating plate before inserting the latter into the casing of the compressor, then assembling such separating plate on the scroll plate of the stationary scroll, without having to meticulously respect the relative positioning of the various bypass and flow passages.

This results in an easy and quick assembly of the various bypass valves in the casing of the compressor, despite the presence of the separating plate.

Furthermore, under normal operating conditions, when the bypass valves are in the closing position, the pressure in the first intermediate volume substantially corresponds to the pressure in the intermediate compression chambers, which is lower than the pressure in the delivery chamber. Furthermore, the temperature of the refrigerant fluid in the intermediate compression chambers communicating with the first intermediate volume is lower than the temperature of the refrigerant fluid in the delivery chamber. Thus, the thermal and mechanical forces exerted on the stationary scroll are reduced.

It should be noted that an intermediate compression chamber refers to a compression chamber having a pressure comprised between the pressure of the first compression chamber "said to be the displacement pressure" and the pressure of the last compression chamber emerging in the delivery conduit.

Advantageously, the first intermediate volume is annular, and is preferably substantially centered on the longitudinal axis of the compressor. These arrangements make it possible to stop further simplify the assembly of the separating plate on the scroll plate of the moving scroll, since regardless of the relative angular position of the separating plate with respect to the scroll plate of the stationary scroll, a fluid connection will be insured between the corresponding bypass and flow passages.

According to one embodiment of the invention, the compressor comprises a plurality of bypass passages.

According to one embodiment of the invention, the compressor comprises a plurality of flow passages and a plurality of bypass valves each associated with a flow passage.

Preferably, the compressor comprises at least one bypass valve made in the form of a strip that is elastically deformable between closing and opening positions for closing and opening the corresponding flow passage.

According to one embodiment of the invention, each flow passage comprises a flow conduit formed in the separating plate and comprising a first end emerging in the first intermediate volume, and a second end emerging in the delivery chamber. Thus, when the compressor comprises a plurality of flow passages, the first end of the various flow conduits emerge in a same volume.

Advantageously, each bypass valve is arranged to close the second end of the corresponding flow conduit when it is in its closing position.

According to one embodiment of the invention, each bypass passage comprises a bypass conduit formed in the scroll plate of the stationary scroll and comprising a first end emerging in the corresponding intermediate compression chamber, and a second end emerging in the first intermediate volume. Thus, when the compressor comprises a plurality of bypass passages, the second ends of the various bypass conduits emerge in a same volume.

Preferably, the first end of each flow conduit is situated substantially across from the second end of a separate bypass conduit.

According to a first alternative of the invention, the compressor comprises more bypass passages that and flow passages. For example, the compressor may include a plurality of bypass passages and a single flow passage.

According to a second alternative of the invention, the compressor comprises the same number of bypass passages and flow passages. According to this alternative, the first end of each flow conduit is preferably situated substantially across from the second end of a separate bypass conduit. These arrangements in particular make it possible to limit pressure losses, and therefore to improve the efficacy of the compressor.

According to one advantageous feature of the invention, the separating plate and the scroll plate of the stationary scroll define at least one second intermediate volume, and the scroll plate of the stationary scroll includes a pressure equalization conduit including a first end emerging in the second intermediate volume and a second end emerging in a volume at a lower pressure than the pressure in the first intermediate volume. Preferably, the second end of the pressure equalization conduit emerges in a suction volume at least partially defined by the moving scroll and the face of the scroll plate of the stationary scroll turned toward the moving scroll.

Advantageously, the second intermediate volume is fluidly isolated from the first intermediate volume.

Preferably, the separating plate includes, on the surface thereof turned toward the scroll plate of the stationary scroll, sealing means arranged to cooperate with the scroll plate of the stationary scroll and partially defining the first intermediate volume. These arrangements make it possible to decrease the dimensions of the first intermediate volume, and therefore to reduce the dead space as well as the biasing area of the separating plate and the scroll plate of the stationary scroll. The reduction of the dead space is advantageous when the compressor has a high compression rate or operates with a high-density refrigerant gas, while reducing the biasing area makes it possible either to manufacture the separating plate and the stationary scroll with materials having a lower mechanical strength, or to decrease the volume of those parts, and therefore the quantity of material used.

According to one embodiment, the sealing means include two annular sealing gaskets with different diameters substantially centered on the longitudinal axis of the compressor.

Each annular sealing gasket is advantageously mounted in an annular slot formed in the surface of the separating plate turned toward the scroll plate of the stationary scroll.

According to one alternative embodiment of the invention, the separating plate includes, on the surface thereof turned toward the scroll plate of the stationary scroll, first and second sealing means arranged to cooperate with the scroll plate of the stationary scroll and respectively partially defining to separate intermediate volumes, and the compressor includes a lease to bypass passages respectively arranged to communicate one of the intermediate volumes with an intermediate compression chamber, and at least two flow passages respectively arranged to communicate one of the intermediate volumes with the delivery chamber.

According to one embodiment, the surface of the separating plate turned toward the delivery chamber has at least one surface inclined from the inside toward the outside and from the delivery chamber toward the stationary scroll, and at least one bypass valve is mounted on said inclined surface.

According to one embodiment of the invention, the scroll plate of the stationary scroll has an outer peripheral wall sealably fastened on the inner wall of the sealed casing.

Preferably, the compressor comprises:

- a delivery conduit, formed the central part of the scroll plate of the stationary scroll, comprising a first end emerging in a central compression chamber and a second end designed to be communicated with the delivery chamber,
- an anti-return device assembled on the scroll plate of the stationary scroll at the second end of the delivery conduit, the anti-return device comprising:
  - at least one delivery opening arranged to communicate the delivery conduit and the delivery chamber,
  - a valve seat surrounding the delivery opening, and
  - a delivery valve movable between a closing position, in which the delivery valve bears against the valve seat and closes the delivery opening, and an opening position in which the delivery valve is separated from the valve seat and opens the delivery opening, the delivery opening being designed to be moved from its opening position when the pressure in the delivery conduit exceeds the pressure in the delivery chamber by a predetermined value.

Preferably, the separating plate is mounted on the scroll plate of the stationary scroll so as to surround the delivery conduit.

According to another advantageous feature of the invention, the compressor comprises sealing means disposed between the separating plate and the scroll plate of the stationary scroll.

BRIEF DESCRIPTION OF THE DRAWINGS

In any case, the invention will be well understood using the following description done in reference to the appended diagrammatic drawing showing, as non-limiting examples, several embodiments of this scroll refrigeration compressor.

DETAILED DESCRIPTION

In the following description, the same elements are designated using the same references in the various embodiments.

Figure 1:
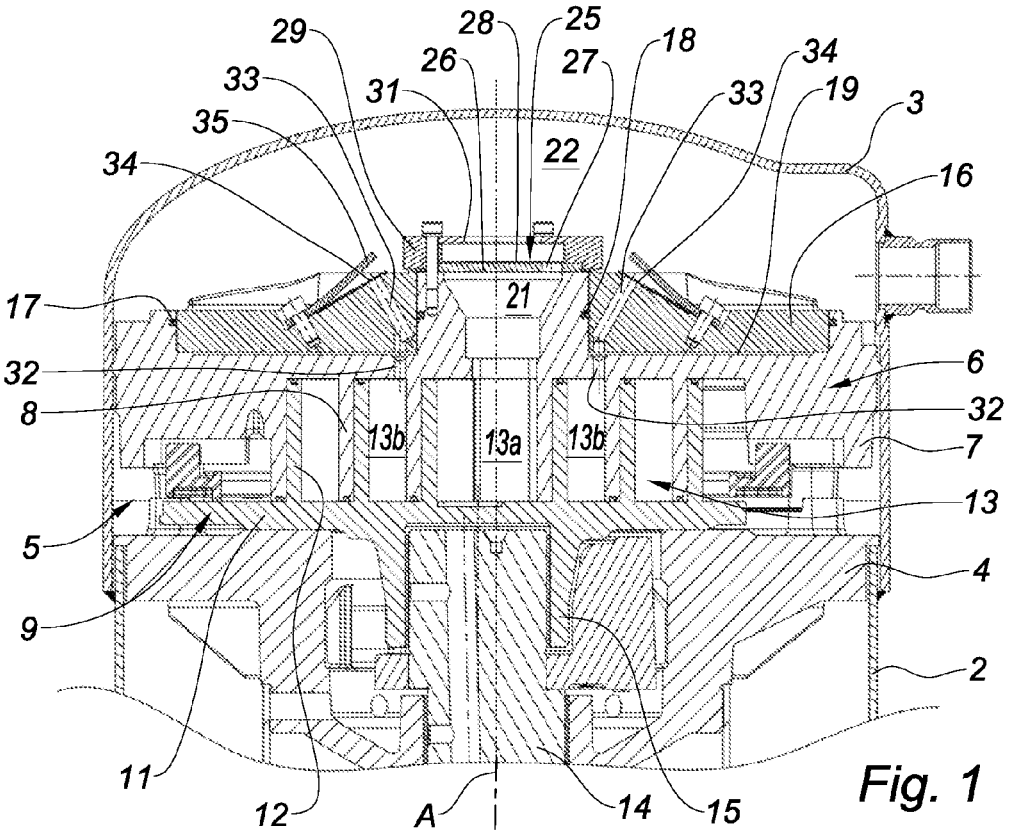
FIG. 1 is a partial longitudinal cross-sectional view of a scroll refrigeration compressor according to a first embodiment of the invention.

FIG. 1 describes a scroll refrigeration compressor in a vertical position. However, the compressor according to the invention may be in an inclined position or horizontal position, without the structure being significantly modified.

The compressor shown in FIG. 1 comprises a sealed casing delimited by a shell 2 whereof the upper and lower ends are respectively closed by a cover 3 and a base (not shown in FIG. 1). The assembly of this casing may in particular be done using weld seams.

The intermediate part of the compressor is occupied by a body 4 that is used to mount a refrigerant gas compression stage 5. This compression stage 5 comprises a stationary scroll 6 including a scroll plate 7 from which a stationary spiral wrap 8 extends turned downward, and a moving scroll 9 including a scroll plate 11 bearing against the body 4 and from which a spiral wrap 12 extends turned upward. The two spiral wraps 8 and 12 of the two scrolls penetrate one another to form variable-volume compression chambers 13.

The compressor comprises an electric motor (not shown in the figures) including a rotor secured to a drive shaft 14 whereof the upper end is off-centered like a crankshaft. This upper part is engaged in a sleeve-forming part 15, included by the moving scroll 9. During rotation thereof by the motor, the drive shaft 14 drives the moving scroll 9 in an orbital movement.

The compressor comprises a separating plate 16 sealably mounted on the scroll plate 7 of the stationary scroll 6. The separating plate 16 is mounted on the scroll plate 7 of the stationary scroll 6 so as to allow a relative movement between the separating plate and the stationary scroll 6 along the longitudinal axis A of the compressor. In order to ensure sealing between the separating plate 16 and the stationary scroll 6, the compressor comprises a first annular seal 17 mounted on the scroll plate of the stationary scroll and arranged to cooperate with the outer edge of the separating plate, and a second annular seal 18 mounted on the scroll plate of the stationary scroll and arranged to cooperate with the inner edge of the separating plate.

The separating plate 16 and the scroll plate 7 of the stationary scroll 6 define an annular intermediate volume 19.

The compressor further comprises a delivery conduit 21 formed in the central part of the stationary scroll 6. The delivery conduit 21 comprises a first end emerging in the central compression chamber 13*a* and a second end designed to be communicated with a high-pressure delivery chamber 22 defined by the casing of the compressor, the scroll plate of the stationary scroll 6 and the separating plate 16. The separating plate 16 is mounted on the scroll plate 7 of the stationary scroll so as to surround the delivery conduit 21.

The compressor comprises an anti-return device 25. The anti-return device 25 includes a valve plate 26 in the form of a disk mounted on the scroll plate 7 of the stationary scroll 6 at the second end of the delivery conduit 21. The valve plate 26 comprises a plurality of delivery openings 27 arranged to communicate the delivery conduit 21 and the delivery chamber 22.

The anti-return device 25 also includes a delivery valve 28 movable between a closing position, in which the delivery valve 28 closes the delivery openings 27, and an open position, in which the delivery valve 28 opens the delivery openings 27. The delivery valve 28 is designed to be moved into its open position when the pressure in the delivery conduit 21 exceeds the pressure in the delivery chamber 22 by a predetermined value substantially corresponding to the adjustment pressure of the delivery valve 28. The delivery valve 28 for example is substantially disk-shaped.

The compressor also comprises a retaining plate 29 mounted on the valve plate 26 and designed to serve as an abutment for the delivery valve 28 when it is in its open position. The retaining plate 29 comprises at least one passage opening 31 arranged to allow a flow of refrigerant fluid from the delivery openings 27 toward the delivery chamber 22. The retaining plate 29 is arranged to limit the travel of the separating plate 16 with respect to the scroll plate 7 of the stationary scroll. In fact, the lower face of the retaining plate forms an abutment arranged to cooperate with the upper face of the separating plate.

The compressor further comprises two bypass passages that are angularly offset with respect to the longitudinal axis A of the compressor and are each arranged respectively to communicate the intermediate volume 19 with an intermediate compression chamber 13*b*. Each bypass passage is formed by a bypass conduit 32 formed in the scroll plate of the stationary scroll and comprising a first end emerging in the corresponding intermediate compression chamber 13*b* and a second end emerging in the intermediate volume 19.

It should be noted that the second ends of the bypass passages emerge in the intermediate volume at a same distance with respect to the longitudinal axis of the compressor.

The compressor also comprises two flow passages that are angularly offset with respect to the longitudinal axis A of the compressor and each arranged to communicate the intermediate volume 19 with the delivery chamber 22. Each flow passage is formed by a flow conduit 33 formed in the separating plate and comprising a first end emerging in the intermediate volume 19 and a second end emerging in the delivery chamber 22.

It should be noted the first ends of the flow passages emerge in the intermediate volume at a same distance with respect to the longitudinal axis of the compressor. Furthermore, the first end of each flow passage emerges in the intermediate volume substantially across from the second end of the bypass passage.

The compressor also comprises two bypass valves 34. Each bypass valve 34 is movable between a closing position for closing one of the flow passages, and an opening position for opening said flow passage. Each bypass valve 34 is designed to be moved into its opening position when the pressure in the corresponding flow passage exceeds the pressure in the delivery chamber 22 by a predetermined value substantially corresponding to the adjustment pressure of said bypass valve 34.

Each bypass valve 34 is assembled on the surface of the separating plate turned toward the delivery chamber, and is arranged to close the second end of the corresponding flow conduit when it is in the closing position thereof.

Furthermore, each bypass valve 34 is advantageously made in the form of a strip that is elastically deformable between a closing position for closing the corresponding flow conduit and an opening position for opening said flow conduit.

The compressor also comprises a retaining plate 35 associated with each bypass valve 34 and designed to serve as an abutment for the corresponding bypass valve 34 when it is in its open position. Advantageously, each retaining plate 35 is fastened on the separating plate by screwing.

The operation of the scroll compressor will now be described.

When the scroll compressor according to the invention is started, the moving scroll 9 is driven by the drive shaft 14 in an orbital movement, this movement of the moving scroll causing an intake and compression of refrigerant fluid in the variable-volume compression chambers 13.

Under optimal operating conditions, each bypass valve 34 is subject, on the face thereof turned toward the separating plate, to a pressure lower than the pressure in the delivery chamber 22. Thus, said bypass valves 34 are kept in their closing position and consequently isolate the intermediate volume 19 from the delivery chamber. Since the intermediate volume 19 is in fluid communication with the intermediate compression chambers 13*b*, the intermediate volume 19 and the intermediate compression chambers 13*b* are substantially at the same pressure.

As a result, all of the refrigerant fluid compressed in the compression chambers 13 reaches the center of the spiral wraps and escapes through the delivery conduit 21 toward the delivery chamber 22 by moving the delivery valve 28 into the open position thereof, and lastly by flowing axially through the delivery openings 27 and the passage opening 31.

Under non-optimal operating conditions, for example seasonally, during startup, or during deicing of the compressor, each bypass valve 34 may be subject, on the face thereof turned toward the separating plate 16, to a pressure higher than the pressure in the delivery chamber 22. In that scenario, the bypass valves 34 deform elastically toward the open position thereof and communicate the intermediate compression chambers 13*b* in which the corresponding bypass passages 32 emerge with the delivery chamber 22 via the intermediate volume 19.

This thereby results in a delivery to the delivery chamber 22 of part of the refrigerant fluid compressed in the intermediate compression chambers 13*b* in which the bypass conduits 32 emerge before that part of the refrigerant fluid reaches the center of the spiral wraps.

Figure 2:
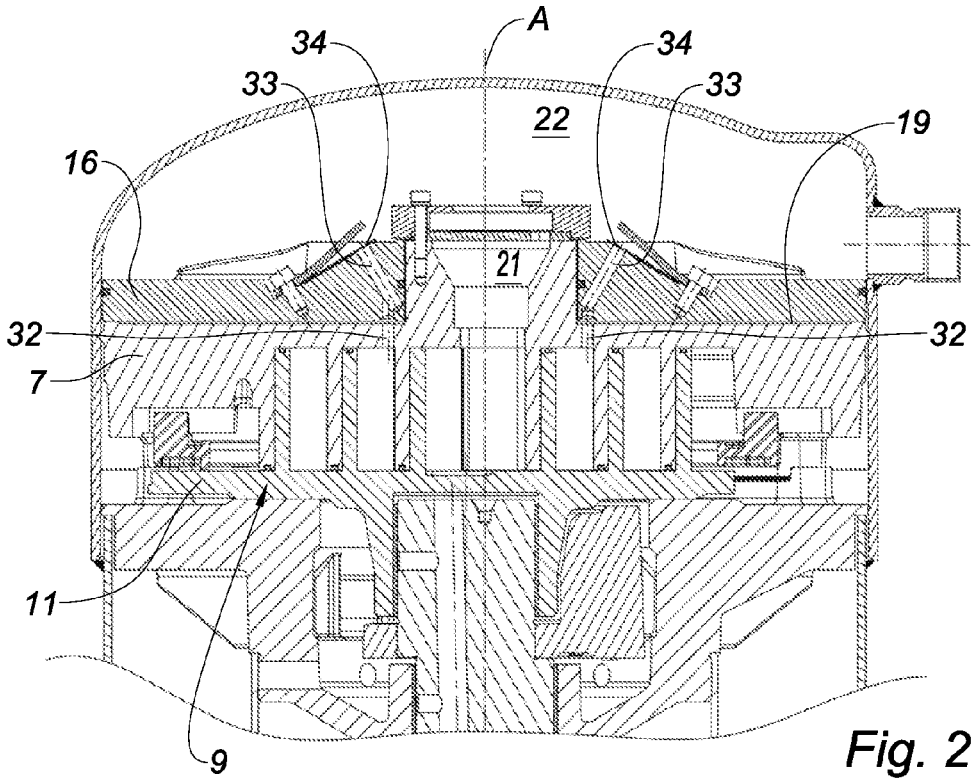
FIG. 2 is a partial longitudinal cross-sectional view of a scroll refrigeration compressor according to a second embodiment of the invention.

FIG. 2 shows a compressor according to a second embodiment of the invention that differs from that shown in FIG. 1 only in that the outer edge of the separating plate 16 sealably cooperates with the inner wall of the cover 3.

Figure 3:
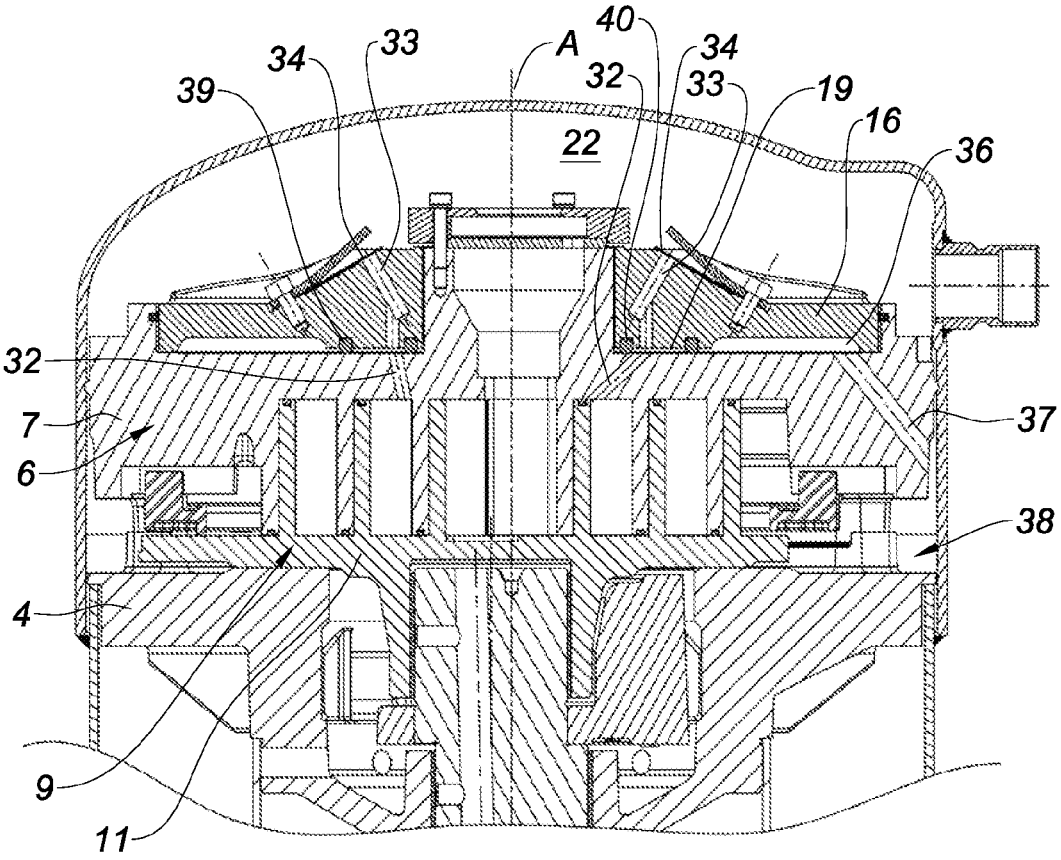
FIG. 3 is a partial longitudinal cross-sectional view of a score refrigeration compressor according to a third embodiment of the invention.
Figure 4:
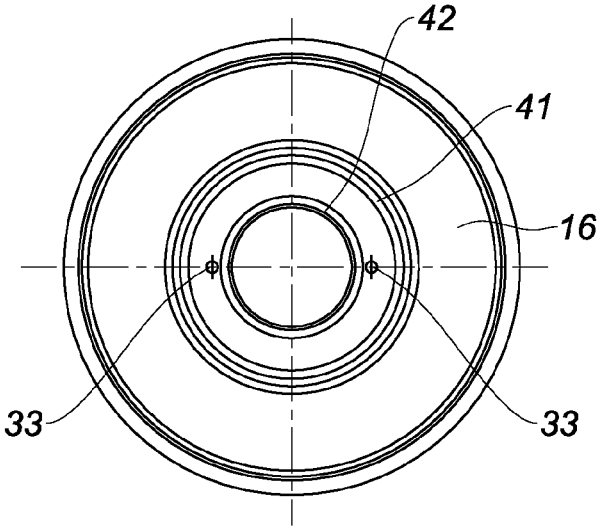
FIG. 4 is a bottom view of the separating plate equipping the compressor of FIG. 3.

FIG. 3 shows a compressor according to a third embodiment of the invention that differs from that shown in FIG. 1 essentially in that the separating plate 16 includes, on the surface thereof turned toward the scroll plate of the stationary scroll, sealing means arranged to cooperate with the scroll plate of the stationary scroll and partially defining the intermediate volume, in that the separating plate 16 and the scroll plate 7 of the stationary scroll 6 define a second intermediate volume 36 fluidly isolated from the first intermediate volume 19, and in that the scroll plate 7 of the stationary scroll 6 includes a pressure equalization conduit 37 including a first end emerging in the second intermediate volume 36, and a second end emerging in a suction volume 38 defined by the body 4, the moving scroll 9 and the face of the scroll plate 7 of the stationary scroll 6 turned toward the moving scroll.

Preferably, the sealing means include two annular sealing gaskets 39, 40 that are concentric and centered on the longitudinal axis of the compressor. Each annular sealing gasket 39, 40 is mounted in an annular slot 41, 42 with a complementary shape formed in the surface of the separating plate turned toward the scroll plate of the stationary scroll.

According to one alternative embodiment not shown in figures, the second end of the pressure equalization conduit 37 may emerge not in a suction volume, but in a compression chamber 13 situated at the beginning of the compression process.

Figure 5:
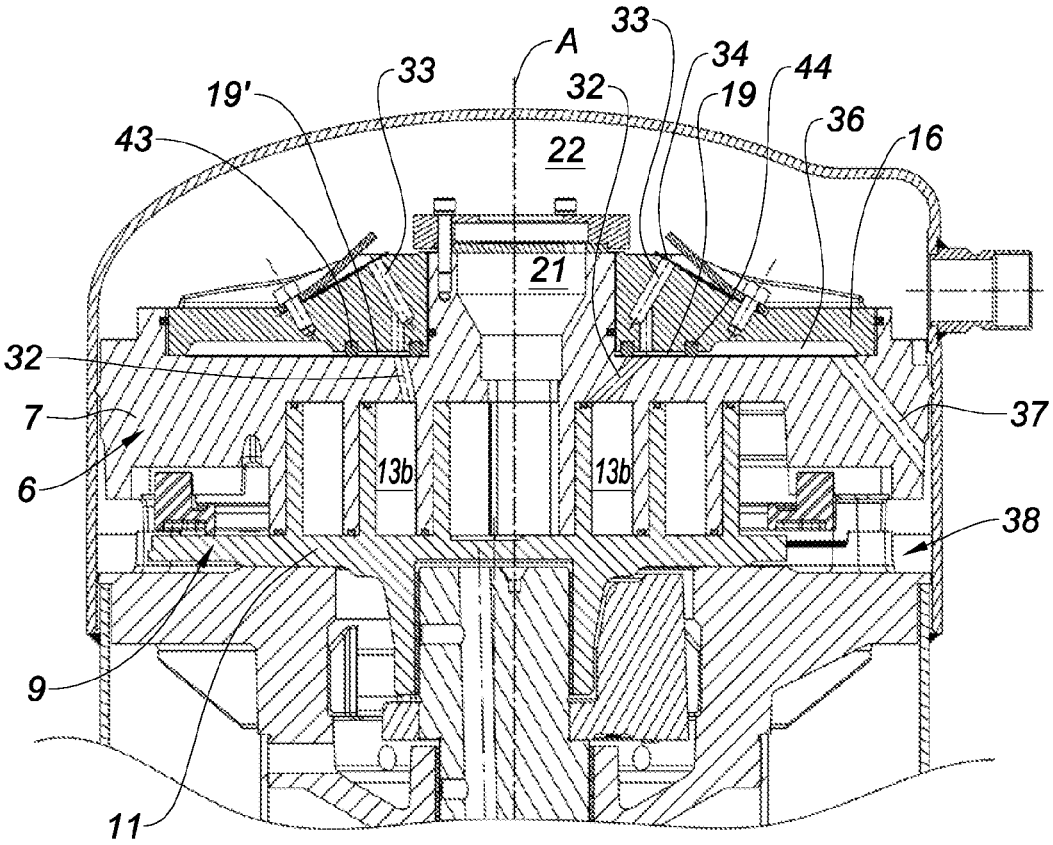
FIG. 5 is a partial longitudinal cross-sectional view of a scroll refrigeration compressor according to a fourth embodiment of the invention.
Figure 6:
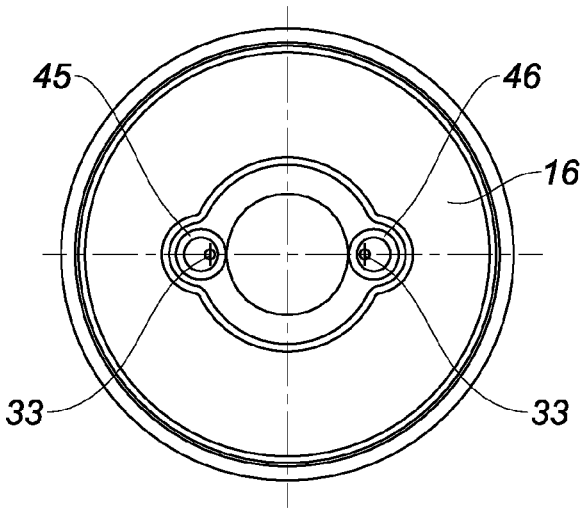
FIG. 6 is a bottom view of the separating plate equipping the compressor of FIG. 5.

FIG. 5 shows a compressor according to a fourth embodiment of the invention that differs from that shown in FIG. 3 essentially in that it includes two annular sealing gaskets 43, 44 that are offset relative to one another and each mounted in an annular slot 45, 46 with a complementary shape formed in the surface of the separating plate turned toward the scroll plate of the stationary scroll so as to surround the first end of a separate flow conduit 33. According to this embodiment, each bypass conduit 32 emerges in a separate intermediate volume 19, 19' with a reduced volume, which makes it possible to increase the dimensions of the second intermediate volume 36, and therefore to decrease the mechanical forces exerted on the stationary scroll.

The invention is of course not limited solely to the embodiments of this scroll refrigeration compressor described above as examples, but on the contrary encompasses all alternative embodiments.

The invention claimed is:

1. A scroll refrigeration compressor comprising:

a sealed casing containing a stationary scroll and a moving scroll following an orbital movement, each scroll including a scroll plate from which a spiral wrap extends, the spiral wraps of the stationary and moving scrolls being engaged in one another and defining variable-volume compression chambers, a separating plate sealably mounted on the scroll plate of the stationary scroll, the separating plate and the scroll plate of the stationary scroll defining at least one first intermediate volume, a delivery chamber at least partially defined by the separating plate and the sealed casing, at least one bypass passage arranged to communicate the first intermediate volume with an intermediate compression chamber, at least one flow passage arranged to communicate the first intermediate volume with the delivery chamber, at least one bypass valve associated with the flow passage, each bypass valve associated with a flow passage being mounted on a surface of the separating plate turned toward the delivery chamber and movable between closing and opening positions for closing and opening the corresponding flow passage, and being configured to be moved into the opening position when the pressure in the corresponding flow passage exceeds the pressure in the delivery chamber by a predetermined value.

2. The compressor according to claim 1, wherein the first intermediate volume is annular.

3. The compressor according to claim 1, wherein the compressor comprises at least one bypass valve made in the form of a strip that is elastically deformable between closing and opening positions for closing and opening the corresponding flow passage.

4. The compressor according to claim 1, wherein each flow passage comprises a flow conduit formed in the separating plate and comprising a first end emerging in the first intermediate volume, and a second end emerging in the delivery chamber.

5. The compressor according to claim 4, wherein each bypass valve is arranged to close the second end of the corresponding flow conduit when said bypass valve is in its closing position.

6. The compressor according to claim 1, wherein each bypass passage comprises a bypass conduit formed in the scroll plate of the stationary scroll and comprising a first end emerging in the corresponding intermediate compression chamber, and a second end emerging in the first intermediate volume.

7. The compressor according to claim 4, wherein the first end of each flow conduit is situated across from the second end of a separate bypass conduit.

8. The compressor according to claim 1, wherein the separating plate and the scroll plate of the stationary scroll define at least one second intermediate volume, and the scroll plate of the stationary scroll includes a pressure equalization conduit including a first end emerging in the second intermediate volume and a second end emerging in a volume at a lower pressure than the pressure in the first intermediate volume.

9. Compressor according to claim 8, wherein the second end of the pressure equalization conduit emerges in a suction volume at least partially defined by the moving scroll and a face of the scroll plate of the stationary scroll turned toward the moving scroll.

10. The compressor according to claim 1, wherein the separating plate includes, on a surface turned toward the scroll plate of the stationary scroll, sealing means arranged to cooperate with the scroll plate of the stationary scroll and partially defining the first intermediate volume.

11. The compressor according to claim 10, wherein the sealing means include two annular sealing gaskets with different diameters centered on a longitudinal axis of the compressor.

* * * * *